United States Patent [19]

Jacobson

[11] 4,424,729

[45] Jan. 10, 1984

[54] ACCESSORY FOR SCREW DRIVER

[76] Inventor: Ralph S. Jacobson, 27970 Le Dunne Ave., R. R. #6, Aldergrove, Canada, V0X 1A0

[21] Appl. No.: 292,682

[22] Filed: Aug. 13, 1981

[51] Int. Cl.[3] ..... B25B 23/08

[52] U.S. Cl. ..... 81/451; 81/452; 248/206 R; 248/362

[58] Field of Search ..... 81/451, 452, 185; 248/206 R, 362, 363; 279/3

[56] References Cited

U.S. PATENT DOCUMENTS

| | | | |
|---|---|---|---|
| Re. 23,201 | 2/1950 | Price | 81/462 X |
| 2,351,666 | 6/1944 | Cohen | 248/206 R |
| 2,721,589 | 10/1955 | Hammer | 81/262 |
| 2,900,757 | 8/1959 | Grimm, Jr. | 248/206 R X |
| 3,638,889 | 2/1972 | Samuelson | 248/206 R |
| 3,916,736 | 11/1975 | Clemens | 81/185 |

*Primary Examiner*—Frederick R. Schmidt
*Assistant Examiner*—Debra S. Meislin
*Attorney, Agent, or Firm*—Carver & Company

[57] ABSTRACT

An accessory for use with a screw driver and screw to prevent the screw driver from accidentally sliding off the screw head. The accessory is a sleeve having a bore to accept freely the screw driver bit and screw therein to permit rotation of the screw driver and screw relative to the bore. A releasable securing structure is mounted on the sleeve so as to engage the surface to receive the screw when an inner end of the sleeve is adjacent the surface, so as to releasably secure the sleeve to the surface. One embodiment of the releasable securing structure includes suction cups mounted adjacent the inner end of the sleeve and positioned so that there is a clearance between the end of the sleeve and the cups to permit the cups to be deformed elastically from an inactive condition prior to attachment to the surface. An alternative structure utilizes actuating devices which deform the suction cups by moving diaphragms thereof towards the surface so as to decrease the volumes thereof prior to attachment, and then to hold the cups and to move the diaphragms away from the surface so as to increase volumes thereof to maintain suction.

7 Claims, 7 Drawing Figures

ACCESSORY FOR SCREW DRIVER

BACKGROUND OF THE INVENTION

1. Field of the Invention

The invention relates to an accessory for use with a screw driver to assist in maintaining positive engagement of the screw driver with a screw.

2. Prior Art

Particularly with a slot headed screw and complementary screw driver, because there is no lateral restraint of a blade of the screw driver with the screw head in one diametrical plane, it is common for the screw driver blade to slip laterally off the screw driver head, commonly damaging the work surface into which the screw is being screwed. In the past, this problem has been reduced to some extent by providing devices which locate the screw driver on the screw and either rotate with the screw, or are manually held against the surface into which the screw is being screwed by the operator. In either structure, there is a risk of damage to the surface by the accessory slipping off the surface, or contacting the surface as the screw head approaches the surface so as to rotate with the head and scratch the surface.

SUMMARY OF THE INVENTION

The invention reduces the difficulties and disadvantages of the prior art by providing an accessory which is releasably secured to the surface which is to be penetrated by the screw, the method of securing being simple and adapted to essentially eliminate damage to the surface by the accessory or by the screw driver slipping accidentally off the screw.

An accessory according to the invention is for use with a screw driver and screw, in which the screw driver has a shank and a screw engaging bit for engaging a head of the screw for screwing the screw into a surface. The accessory is characterized by a sleeve and releasable securing means. The sleeve has a bore to accept freely the screw driver bit and screw therein so as to permit rotation of the screw driver and screw relative to the bore. The releasable securing means are mounted on the sleeve so as to engage the surface when an inner end of the sleeve is generally adjacent the surface, so as to releasably secure the sleeve to the surface the releasable securing means include support means, suction cup means and actuating means. The support means extend outwardly from the sleeve so as to be adjacent the inner end of the sleeve, the support means having an opening therein. The suction cup means having an essentially rigid tube member having inner and outer ends. The inner end of the member is open and adapted to make sealing contact with the surface, and the outer end of the tube member has a flexible diaphragm member extending thereacross so as to close the outer end of the tube member. The actuating means extends through the opening of the support means and cooperates with the diaphragm and the support means. Thus, in a first position, the actuating means can be depressed in deflect the diaphragm to displace air from the suction cup by reducing effective volume of the suction cup. To attain a second position from the first position, the inner end is then sealed against the surface and the actuating means is moved relative to the support means to deform the diaphragm from the first position to increase volume of the suction cup so as to actuate the suction cup to reduce pressure therein so as to grip the surface.

A detailed disclosure following, related to drawings, describes preferred embodiments of the invention, which is capable of expression and structure other than particularly described and illustrated.

DETAILED DISCLOSURE

Figures 1 through 3

Figure 2:
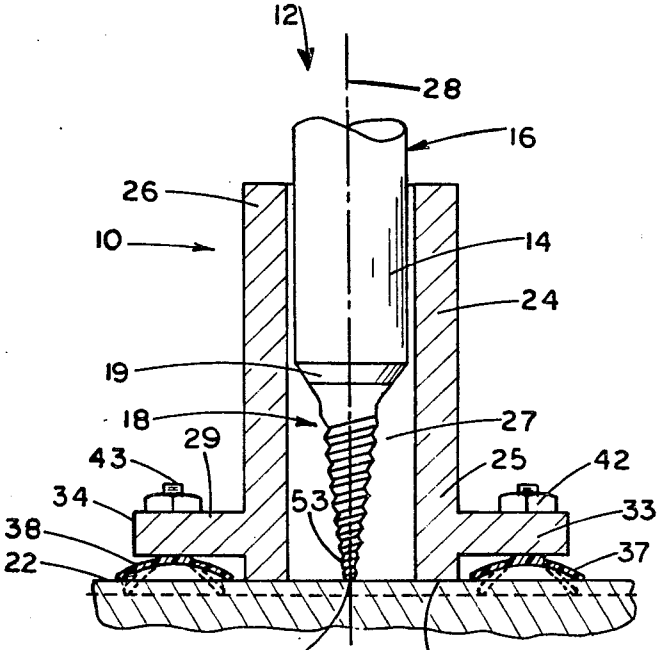
FIG. 2 is a simplified fragmented section, generally on line 2-2 of FIG. 1, with the device shown in a position engaging the surface, the releasable means being in an active condition engaging the surface and a screw driver engaging the screw.

An accessory 10 according to the invention is shown in use with a screw driver 12 having a screw driver blade 14 at an end of a screw driver shank 16. A screw 18 has a screw head 19 having a screw driver slot 20 for engagement by the blade 14. The blade 14 is a screw engaging bit which engages the slot 20 of the screw head for screwing the screw into a surface 22 and serves as complementary engaging means. Alternative known complementary engaging means for the bit and screw head can be substituted, although the invention has particular application for slot headed screws which appear to be the most prone to accidental disengagement of the screw from the screw driver.

The accessory 10 includes a sleeve 24 having open inner and outer ends 25 and 26 and a bore 27 disposed concentrically about a sleeve axis 28. The bore accepts freely the screw driver bit or blade 14 and screw 18 therein so as to permit rotation of the screw driver and screw relative to the bore. Three radial arms 32 through 34 extend from the inner end 25 and carry flexible suction cups 36, 37 and 38 respectively, the cups being secured by respective nut and bolt means 41, 42 and 43 passing through openings in the arms. The arms serve as support means 29 which extend outwardly from the sleeve so as to be adjacent the inner end thereof. The suction cups serve as suction cup means or releasable securing means 30 adjacent the inner end of the sleeve and mounted on the support means and adapted to engage the surface when the inner end of the sleeve is generally adjacent the surface.

Figure 3:
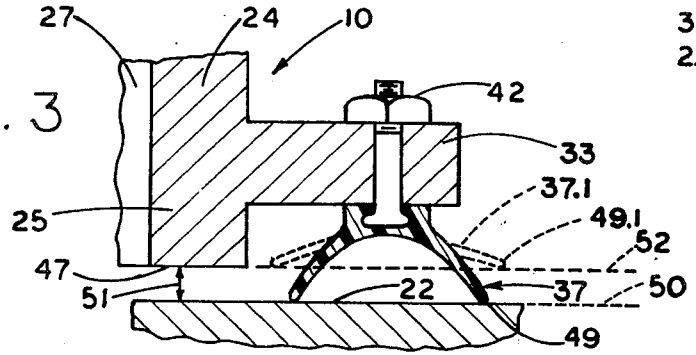
FIG. 3 is a fragmented detailed section of one of the releasable securing means shown in full outline in an inactive condition, and in broken outline in an active condition.

Referring specifically to FIGS. 2 and 3, the sleeve 24 has an annular inner end face 47 disposed normally to the axis 28 so that the sleeve extends normally from the surface when the end face is held thereagainst. In FIG. 3, the suction cup 37 has a suction cup lip 49 which, in an inactive condition as shown in full outline, is disposed within a plane 50 spaced from the inner end face 47 of the sleeve 24 by a spacing 51. The cup 37 is shown in broken outline in a secured or active condition designated 37.l, in which the suction cup lip 49 is shown in broken outline at 49.1 and within a plane 52 which is coplanar with the end face 47, and thus represents the upper surface 22 when the end face 47 is held against the surface. In the active condition, it can be seen that the lip 49 has spread radially outwardly and volume within the suction cup has decreased, and the suction cup has been actuated so that the cup grips the surface 22. Thus, the spacing 51 between the planes 50 and 52 permits sufficient deformation of the cup upon contact with the surface 22 to actuate the cup so that the cup grips the surface, thus holding the accessory 10 onto the surface. The use of suction cup means, which in this embodiment includes a suction cup mounted on each arm or support means, provides three spaced points of securing contact with the surface 22, thus essentially preventing rocking of the accessory relative to the surface so as to maintain the end face in intimate contact with the surface. Elasticity of the suction cups sometimes results in a slight increase in volume within the cups following initial actuation of the cups, and this can produce a small gap between the end face 47 and the surface 22, but this does not effect operation of the device.

OPERATION

In operation, the accessory is positioned relative to the surface 22 so that the axis 28 is aligned with the position in which the screw is to penetrate the surface, usually an indentation 54 in the surface 22 sufficient to accept a point 53 of the screw. The three suction cups 36, 37 and 38 are pressed so as to be essentially flattened to the active condition, as shown in broken outline in FIG. 3, and to hold the accessory against the surface so that the end face 47 is held closely against the surface. If necessary, the suction cups, or the surface, can be moistened slightly before application to augment gripping of the suction cups to the surface. When the accessory is correctly in place, after a visual check in the bore 27 to ensure that the bore 27 is concentric with the desired location of the screw, the screw can be inserted through the outer end 26 to engage the identation in the surface. The screw driver blade 14 is then inserted in the slot 20 and, applying normal pressure, the screw is driven into the surface as required. When the blade 14 and screw head 19 are relatively close fits within the bore 27, it can be seen that there is little tendency for the blade to slide relative to the screw head, and similarly, the screw 18 is constrained to be held generally normally to the surface 22 and axially relative to the bore so as to prevent undesirable inclination of the screw to the surface.

In summary, it can be seen that when the suction cup lip 49 is in an inactive condition, it is spaced from a plane containing the end face 47 by the spacing 51, which spacing serves as a clearance means, associated with the suction cup, to permit the cup to be deformed elastically from an inactive condition so as to actuate the cup to the active condition when the inner end of the sleeve is adjacent the surface. When the screw has been screwed into the surface, the accessory can be removed by prying up the suction cups to permit removal of the accessory from the surface. If desired, a thin blade can be inserted between the suction cup lips and the surface to break the low pressure seal therebetween.

ALTERNATIVES AND EQUIVALENTS

The device is shown with three arms extending generally radially outwardly, but clearly in some applications, two arms might be acceptable, whereas in other applications, four might be preferred. In any event, in the inactive condition, the cup lips should extend as shown to provide the clearance for actuation of the cups, although cups can be actuated by positive mechanical means, as will be described with reference to FIGS. 5 through 7.

Figure 4

In some applications, it may be necessary to insert a screw that is considerably smaller than the bore 27 of the sleeve 24. If a screw having a head with a diameter very much less than the bore 27 were inserted in the accessory, in all likelihood, the screw would be inclined to the axis 28 and also, because the screw head would have a thinner slot, a screw driver having a smaller diameter shank would in all likelihood be required, which would not be constrained by the bore 27, and thus would not function in a manner according to the invention. To overcome this difficulty, an adaptor bushing 60 can be used as follows.

An alternative screw driver 61 has an alternative shank 62 having a blade or bit 65 adapted to fit an alternative screw 68. The alternative screw and screw driver have engaging means sizes less than the first screw and screw driver of FIGS. 1 through 3, which, without the adaptor bushing 60, would be prone to misalignment within the bore 27 due to excessive clearance between the shank 62 and screw 68 relative to the bore. The adaptor bushing has an outer surface 70 adapted to fit within the bore 27 of the sleeve and also has a bushing bore 72 to receive the shank 62, the blade 65 and screw 68 as shown. As there is little clearance between the bushing bore 72 and the screw and screw driver, alignment is maintained as in the first embodiment. Different sizes of adaptor bushings, all having the same outer surface diameter, can be used to accomodate screws and complementary screw drivers of different sizes.

Figures 4, 5, 6, 7:
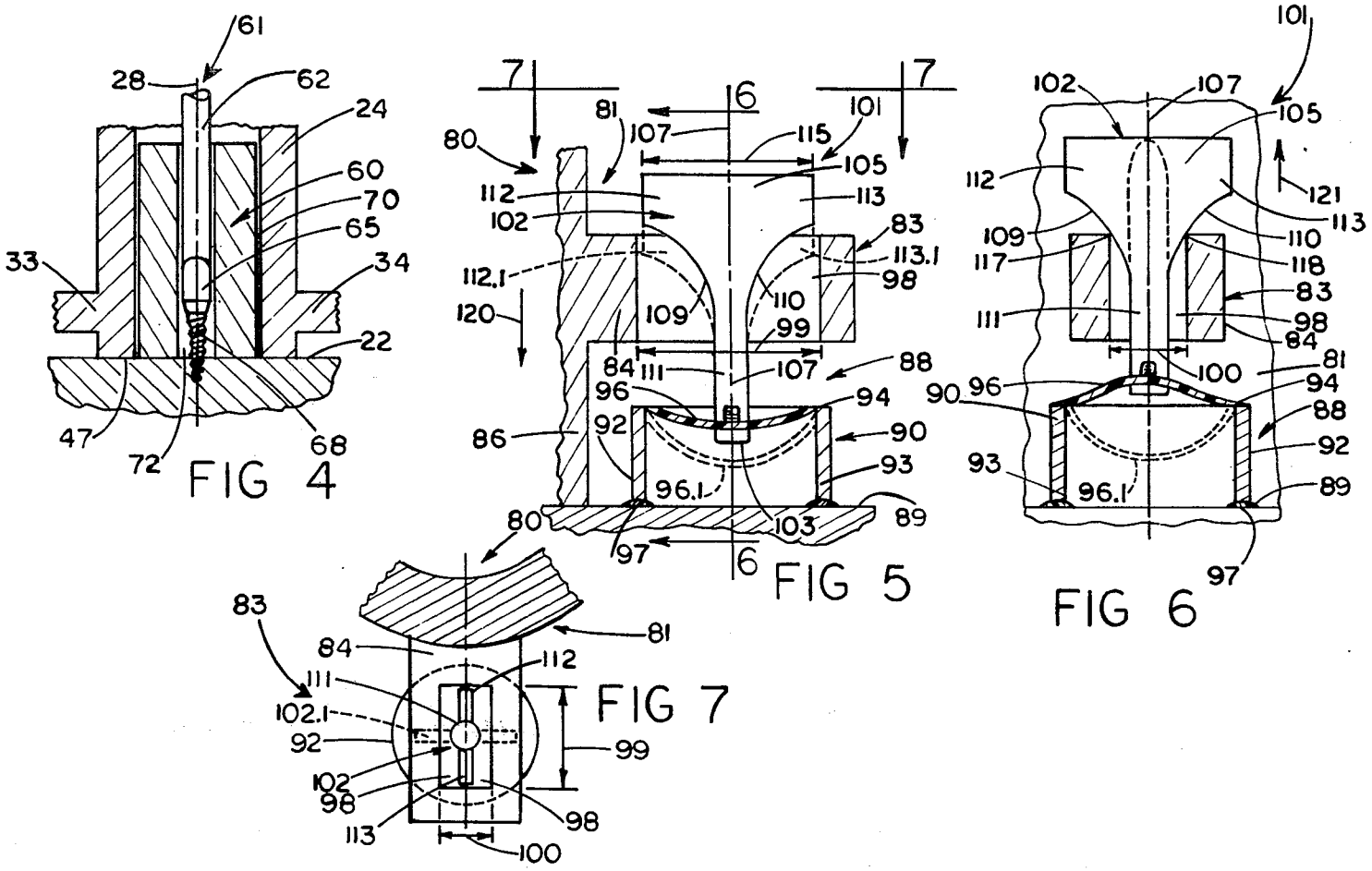
FIG. 4 is a simplified fragmented detailed section showing an additional accessory for smaller diameter screws.
FIG. 5 is a fragmented detailed section of a second embodiment of one releasable securing means according to the invention, a plane of the section being generally similar to a portion of FIG. 2, the device being shown in full outline in an inactive condition prior to securing to the surface and in broken outline in an intermediate condition.
FIG. 6 is a simplified fragmented section of the second embodiment of the securing means, as seen generally from line 6—6 of FIG. 5, the device being shown in full outline in a secured or active condition, and in broken outline in the intermediate condition.
FIG. 7 is a simplified fragmented top plan of the second embodiment of the securing means, as seen from line 7—7 of FIG. 5, portions of the device being shown in full outline in the inactive condition, and in broken outline in the active condition.

FIGS. 5 through 7

Figure 1:
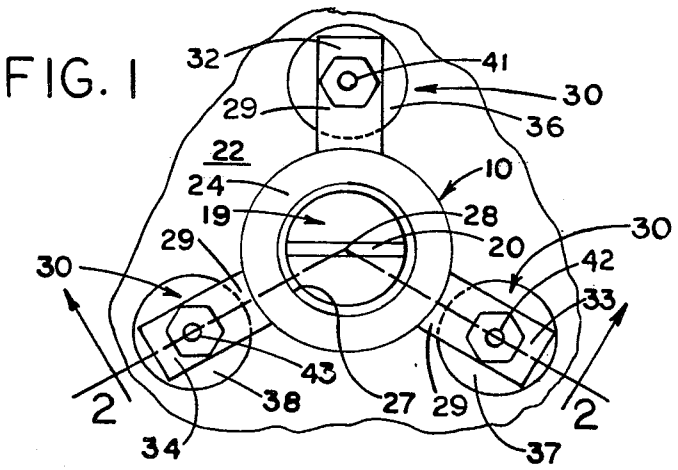
FIG. 1 is a top plan of a first embodiment of the invention shown with a slot headed screw therein.

Portions of an alternative accessory 80 are to be described, which accessory has a sleeve 81 having a bore, not shown, which is generally similar to the sleeve 24 and bore 27 of FIGS. 1 through 3. However this accessory 80 has alternative support means, a typical support means 83 being shown and having a radial arm 84 extending adjacent an inner end 86 of the sleeve 81. The support means has an alternative releasable securing means 88 which includes an alternative suction cup means 90 having an essentially rigid tube member 92 with inner and outer ends 93 and 94 respectively. The suction cup means also has a flexible diaphragm member 96 extending across the outer end of the tube member 92 so as to close the outer end thereof, and a resilient rim 97 on the inner end to augment sealing of the end 93 against a surface 89.

The support means 83 has an elongated opening 98 having a maximum dimension or length 99 coincident with a radial direction of the sleeve 81, and a minimum dimension or width 100. An actuating means 101 has a key member 102 extending through the opening 98 and having an inner end 103 which is swivellably connected to the diaphragm 96, and an outer end 105 adapted to be gripped by fingers of an operator. The key member 102 has a central axis 107 generally coincident with an axis of the tube member 92, and cam portions 109 and 110 of the outer end have curved surfaces extending from a shank portion 111 to wings 112 and 113 respectively. As best seen in FIG. 5, the wings have an overall span 115 which is less than the maximum dimension 99 of the opening 98 so as to permit the wings to pass through the opening 98. As best seen in FIG. 6, the shank portion 111 has a diameter less than the width 100 of the opening 98, and spacing between the cam surfaces 109 and 110 of the wings is generally greater than the width 100 so that the cam surfaces cooperate with opposite edges 117 and 118 on an upper portion of the periphery of the elongated opening 98. The alternative accessory 80 has three similar support means extending radially outwardly to provide three points of securing contact and three similar suction cup means which can be made to function similarly as described.

In operation, the accessory 80 is placed so that an axis of the bore of the sleeve 81, not shown, is aligned with the point of application of the screw and the three alternative suction cup means 90 are activated in sequence as follows. The key member 102 is depressed towards the surface 89 in direction of an arrow 120 so that the diaphragm 96 assumes a broken outline shape 96.1, thus displacing air from the suction cup means between the inner end 93 and the surface 89. In this position, the wings 112 and 113 assume broken outline positions 112.1 and 113.1 as seen in FIG. 5, and this is defined as a first position. Resilience in the diaphragm 96 tends to return the diaphragm upwards, ie. away from the surface 89, to attain the full outline position as shown in FIG. 5. Alternatively, the key member 102 is pulled upwards by the operator to assume the full outline position of FIG. 5, in which the wings are clear of the opening 98. The rim 97 seals lightly against the surface 89, because pressure in the securing means 88 is lowered due to a first increase in effective volume of the pump means which occurs when the diaphragm moves from the broken outline shape 96.1 to the full outline shape 96. The key member 102 is then rotated through approximately 90°, as shown at 102.1 in broken outline in FIG. 7, and in full outline in FIG. 6, so that the cam surfaces 109 and 110 ride on the edges 117 and 118 producing a movement of the actuating means in direction of an arrow 121. This upwards movement ie. away from the surface 89, draws the diaphragm upwardly to a full outline position as shown in FIG. 6 so that the diaphragm is deformed to produce a second increase in effective volume of the suction cup, thus decreasing pressure further within the means 88 to draw the end 93 more firmly against the surface.

Thus, the key member is an actuating means cooperating with the diaphragm and extending through the opening of the support means so that in a first position, the actuating means can be depressed to deflect the diaphragm to displace air from the suction cup by reducing effective volume of the suction cup. To attain the second position of the actuating means from the first position, the actuating means is moved relative to the support means to deform the diaphragm to increase effective volume of the suction cup, so as to actuate the suction cup to grip the surface. In effect the opening in the support means is an elongated slot having a shape to accept the actuating means in the first position to permit generally axial movement of the actuating means therethrough, and in the second position, the shape essentially prevents axial movement of the actuating means. Clearly, alternative shapes or dispositions of an elongated slot can be selected to provide a similar purpose. It can be seen that the actuating means is a member having cam means which cooperate with the support means so that in the first position thereof, the actuating means can move generally axially through the opening to reduce effective volume of the suction cup, and in moving from the first position to the second position, the actuating means moves essentially axially through the opening to increase effective volume of the suction cup. It is noted that this is a more positive way of actuating the suction cup than the simple suction cup shown in FIGS. 1 through 3, and, by selection of required movements of the actuating means, a considerable suction force can be attained. This is of particular advantage where the accessory is to be used for screwing into an overhanging surface, eg. a ceiling of a room, and in certain applications where the surface into which the screw is to be screwed is of poor characteristics for accepting a conventional suction cup.

I claim:

1. An accessory for use with a screw driver and screw, the screw driver having a shank and screw engaging bit for engaging a head of the screw for screwing the screw into a surface, the accessory including a sleeve having a bore to accept freely the screw driver bit and screw therein so as to permit rotation of the screw driver and screw relative to the bore, the accessory being further characterized by:

releasable securing means mounted on the sleeve so as to engage the surface when an inner end of the sleeve is generally adjacent the surface, the releasable securing means having:

(a) support means extending outwardly from the sleeve as to be adjacent the inner end of the sleeve, the support means having an opening therein, (b) suction cup means cooperating with the support means and adapted to engage the surface when the inner end of the sleeve is generally adjacent the surface, the suction cup means having an essentially rigid tube member having inner and outer ends, the inner end of the tube member being open and adapted to make sealing contact with the surface, and the outer end of the tube member having a flexible diaphragm member extending thereacross so as to close the outer end of the tube member, (c) actuating means extending through the opening of the support means and cooperating with the diaphragm and the support means so that in a first position, the actuating means can be depressed to deflect the diaphragm to displace air from the suction cup by reducing effective volume of the suction cup; and, to attain a second position from the first position, the inner end is then sealed against the surface and the actuating means is moved relative to the support means to deform the diaphragm from the first position to increase volume of the suction cup so as to actuate the suction cup to reduce pressure therein so as to grip the surface.

2. An accessory as claimed in claim 1 in which the securing means is further characterized by:

(a) the opening in the support means is an elongated slot having a shape to accept the actuating means in the first position to permit generally axial movement of the actuating means therethrough, and in the second position, the shape essentially prevents axial movement of the actuating means, (b) the actuating means is a member having cam means which cooperate with the support means so that, in the first position, the actuating means can move generally axially through the opening to reduce effective volume of the suction cup, and in moving from the first position to the second position, the actuating means moves generally axially through the opening to increase effective volume of the suction cup.

3. An accessory as claimed in claim 1 further including:

(a) an adaptor bushing having an outer surface adapted to fit within the bore of the sleeve and a bushing bore to receive a second screw and screw driver therein, in which sizes of the engaging means of the second screw and screw driver are less than the first screw and screw driver.

4. An accessory as claimed in claim 2 in which the actuating means is further characterized by:

(a) a key member having an inner end swivellably connected to the diaphragm, and an outer end having the cam means and which can be gripped by an operator and has a span less than maximum dimension of the elongated slot, so as to permit the outer end to pass through the slot in the first position, and when the outer end is clear of the slot, the actuating means can be rotated about the axis thereof so that the cam means cooperates with opposite edges of the elongated opening, so as to move the actuating means and the diaphragm axially away from the surface to attain the second position in which the actuating means is held in place, thus maintaining the increased volume of the suction cup.

5. An accessory as claimed in claim 2 in which:

(a) the elongated slot has a maximum dimension coincident with a radial direction of the sleeve.

6. An accessory as claimed in claim 1 further characterized by:

(a) the suppport means having three arms extending generally radially outwardly from positions generally adjacent the inner end of the sleeve, each support means carrying a respective suction cup means and respective actuating means, so as to provide three spaced points of securing contact with the surface.

7. An accessory as claimed in claim 6 in which:

(a) the openings in the arms of the support means are elongated slots having a maximum dimension coincident with a radial direction of the sleeve.

* * * * *